US007931496B2

(12) United States Patent
Ushiro et al.

(10) Patent No.: US 7,931,496 B2
(45) Date of Patent: Apr. 26, 2011

(54) ELECTRICAL CONNECTOR

(75) Inventors: Yutaka Ushiro, Kanagawa (JP); Katsuyuki Masaki, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/659,839

(22) Filed: Mar. 23, 2010

(65) Prior Publication Data

US 2010/0248536 A1 Sep. 30, 2010

(30) Foreign Application Priority Data

Mar. 26, 2009 (JP) ..... 2009-075422

(51) Int. Cl.
*H01R 13/73* (2006.01)

(52) U.S. Cl. ..... 439/557; 439/353

(58) Field of Classification Search ..... 439/353, 439/357, 378, 545, 553–559
See application file for complete search history.

(56) References Cited

U.S. PATENT DOCUMENTS

| | | | | |
|---|---|---|---|---|
| 7,575,472 | B1 * | 8/2009 | Wu | 439/545 |
| 7,607,930 | B1 * | 10/2009 | Wu | 439/247 |

FOREIGN PATENT DOCUMENTS

| | | | |
|---|---|---|---|
| JP | 63-145279 | U | 9/1988 |
| JP | 04-021270 | Y | 5/1992 |
| JP | 05-226035 | A | 9/1992 |
| JP | 08-273737 | A | 10/1996 |
| JP | 11-091441 | A | 4/1999 |
| JP | 2002-025689 | A | 1/2002 |
| JP | 2002-025690 | A | 1/2002 |
| JP | 2002-025692 | A | 1/2002 |
| JP | 2002-025693 | A | 1/2002 |
| JP | 2002-025713 | A | 1/2002 |
| JP | 2002-042960 | A | 2/2002 |
| JP | 2002-319460 | A | 10/2002 |
| JP | 2005-228484 | A | 8/2005 |
| JP | 2007-273115 | A | 10/2007 |
| JP | 2009-054590 | A | 3/2009 |

* cited by examiner

*Primary Examiner* — Khiem Nguyen
(74) *Attorney, Agent, or Firm* — Rader, Fishman & Grauer PLLC

(57) ABSTRACT

A connector includes a housing to be attached to a front face of a panel. A panel has a mounting opening through which a rear portion of the housing is inserted. The rear portion of the housing has a lance extending in a direction parallel to the front face of the panel. The mounting opening has a concave portion through which the lance is inserted. When the housing is moved in a first direction along the front face of the panel, a locking piece that continues to a concave portion locks the tip of the lance such that the housing is difficult to move in a second direction.

7 Claims, 14 Drawing Sheets

ELECTRICAL CONNECTOR

This application is based on and claims the benefit of priority from Japanese Patent Applications No. 2009-075422, filed on 26 Mar. 2009, the content of which is incorporated herein by reference.

BACKGROUND OF THE INVENTION

1. Field of the Invention

The present invention relates to an electrical connector. In particular, the present invention relates to a structure of an electrical connector (hereinafter referred to as a connector) of a panel attachment type to be attached to a board, a panel, a frame and the like.

2. Related Art

Generally, as a connector of a panel attachment type, a rectangular connector having a rectangular joining face is known. For example, such a rectangular connector includes a pair of cantilevered locking arms in both wings of a housing. It is configured such that, when the housing is inserted through a rectangular opening provided to a panel, the pair of locking arms is locked to the opening of the panel, thereby fixing the connector.

Since tips of the locking arms are open in the connector of the panel attachment type according to the prior art, there has been a drawback that load is imposed on the ends of the locking arms due to insertion and removal operations of the counterpart connector. On the other hand, if the ends of the locking arms are reinforced, there has been a drawback in that insertion through the opening of the panel becomes difficult.

In order to eliminate such drawbacks, for example, Japanese Unexamined Utility Model Application Publication No. S63-145279 (Patent Document 1) has disclosed a connector of a panel attachment type, which is provided with flexible connecting portions for connecting tips of locking arms and a housing.

FIG. 20 is a perspective view showing an appearance of a connector of a panel attachment type disclosed in Patent Document 1. FIG. 20 of the present application corresponds to FIG. 1 of Patent Document 1.

With reference to FIG. 20, a connector 8 is provided with a pair of locking arms 82 and 82 on both sides 81 and 81 of a housing 80. Ends of the locking arms 82 are joined to side faces 81. In addition, the locking arms 82 are arranged at an inclination so as to open outward.

On the other hand, with reference to FIG. 20, a panel 9 is provided with a rectangular opening 91 through which the housing 80 is inserted. The opening 91 is provided with a pair of notched concave portions 92 and 92 in both wings thereof. The pair of locking arms 82 and 82 can be inserted through the pair of concave portions 92 and 92. In addition, when the connector 8 is inserted through the opening 91, the pair of locking arms 82 and 82 can deform to close inward.

With reference to FIG. 20, step-shaped steps 83 are provided to tips of the locking arms 82. Furthermore, upper end portions of the locking arms 82 are connected to the side faces 81 of the housing 80 by way of flexible connecting portions 87 that are relatively thin and bend easily. Moreover, a pair of flange portions 84 and 84, which abut a rear face of the panel 9, protrudes from side edges of the housing 80.

In FIG. 20, when the connector 8 is inserted through the panel 9, the pair of steps 83 and 83 abuts the concave portions 92 and 92 and deforms, and the resilient pressure thereof fixes the connector 8.

The connector 8 disclosed in Patent Document 1 is described as having no risk of bending the locking arms 82, which are reinforced by way of the flexible connecting portions 87, more than necessary even if load is imposed on the locking arms 82 by insertion and removal with the counterpart connector.

However, since the connector according to Patent Document 1 includes the pair of locking arms in both wings, there is a problem in that the external shape of the connector is enlarged.

In addition, in the connector according to Patent Document 1, although the pair of locking arms is reinforced by way of the flexible connecting portions, this is a configuration in which the load is imposed on the ends of the locking arms due to insertion and removal with the counterpart connector, and there is a problem in that the ends of the locking arms will suffer from fatigue as insertion and removal with the counterpart connector are repeated.

SUMMARY OF THE INVENTION

The present invention has been made in view of such problems, and an object thereof is to provide a connector of a panel attachment type, in which load is unlikely to be imposed on a locking arm by insertion and removal with a counterpart connector, and an external shape is not enlarged.

A first aspect of the present invention is an electrical connector of a square shape having a housing of a front face attachment type to be attached to a front face of a panel, in which the housing includes a front portion and a rear portion, and the panel includes a mounting opening of rectangular shape through which the rear portion of the housing is inserted in a direction substantially orthogonal to the front face of the panel, the rear portion of the housing includes: a boundary step abutting a periphery of the front face of the mounting opening; a lance arranged adjacently to the boundary step, in which an end thereof joins a first external wall of the housing, and a tip thereof extends away from the first external wall in a direction parallel to the front face of the panel; and a plurality of flanges arranged discontinuously around the housing to oppose the boundary step, and the mounting opening includes: a plurality of concave portions notched toward a panel thickness face of the panel through which the lance and the plurality of flanges are inserted; and a plurality of convex portions, where the plurality of flanges abuts the rear face of the panel when the housing is moved in a first direction along the front face of the panel, and the plurality of convex portions includes a locking piece that locks the tip of the lance when the housing is moved in the first direction along the front face of the panel, such that the housing is difficult to move in a second direction.

The rectangular electrical connector is basically rectangular, and has a rectangular joining face that joins with a counterpart electrical connector. The housing of a front face attachment type may be attached to the front face (outside) of the panel, and can be attached to or removed from the front face side of the panel only. In the housing of a front face attachment type, the rear portion of the housing protrudes to the rear face side of the panel with the boundary step as a boundary thereof.

The panel is a member to which the electrical connector according to the present invention is attached, generally refers to a flat plate such as a board and a frame having a predetermined area, and is not limited by a name of a panel.

The housing may have insulation characteristics, the housing having insulation characteristics may be a housing made of a non-conductive material, and a housing of a desired shape having insulation characteristics can be obtained by molding synthetic resin.

The electrical connector may be a plug or a receptacle. A male contact or a female contact may be mounted to the housing. The contact may be a crimp contact that crimps a terminal of an electric wire, or may be a pressuring-welding contact that pressure-welds a terminal of an electric wire. A power supply contact and a signal contact may coexist in the housing, and the electrical connector can be made as a hybrid connector.

In the electrical connector according to the first aspect of the present invention, when the rear portion of the housing is inserted through the mounting opening in the direction substantially orthogonal to the front face of the panel, the boundary step abuts the periphery of the front face of the mounting opening, and can stop. In addition, in this state, the lance faces the panel thickness face of the mounting opening.

The boundary step and the plurality of flanges are provided so as to sandwich both sides of the periphery of the mounting opening, and when the housing is moved in the first direction along the front face of the panel, the tip of the lance is depressed by the locking piece and passes over the locking piece.

When the tip of the lance completely passes over the locking piece, and the housing abuts the end face of the mounting opening and stops, the tip of the lance returns and is locked with the locking piece, thereby making it possible to lock the housing so as to be difficult to move in the second direction.

Moreover, in the electrical connector according to an applied aspect of the first aspect, the rear portion of the housing includes a step-shaped step corresponding to a panel thickness of the panel between the boundary step and the plurality of flanges, and the mounting opening has an opening shape that is different depending on the panel thickness of the panel.

A second aspect of the present invention is an electrical connector of a square shape having a housing of a rear face attachment type to be attached from a rear face to a front face of a panel, in which the housing includes a front portion and a rear portion, and the panel includes a mounting opening of rectangular shape through which a front portion of the housing is inserted in a direction substantially orthogonal to the rear face of the panel, the front portion of the housing includes: a boundary step abutting a periphery of the rear face of the mounting opening; a lance arranged adjacently to the boundary step, in which an end thereof joins a first external wall of the housing, and a tip thereof extends away from the first external wall in a direction parallel to the rear face of the panel; and a plurality of flanges arranged discontinuously around the housing to oppose the boundary step, the mounting opening includes: a plurality of concave portions notched toward a panel thickness face of the panel through which the lance and the plurality of flanges are inserted; and a plurality of convex portions, where the plurality of flanges abuts the front face of the panel when the housing is moved in a first direction along the rear face of the panel, and the plurality of convex portions includes a locking piece that locks the tip of the lance when the housing is moved in the first direction along the rear face of the panel, such that the housing is difficult to move in a second direction.

The housing of a rear face attachment type may be attached to the rear face (inside) of the panel, and can be attached to or removed from the rear face side of the panel only. In the housing of the rear face attachment type, the front portion of the housing protrudes to the front face side of the panel with the boundary step being a boundary thereof.

In the electrical connector according to the second aspect of the present invention, when the front portion of the housing is inserted through the mounting opening in the direction substantially orthogonal to the rear face of the panel, the boundary step abuts the periphery of the rear face of the mounting opening, and can stop. In addition, in this state, the lance faces the panel thickness face of the mounting opening.

The boundary step and the plurality of flanges are provided so as to sandwich both sides of the periphery of the mounting opening, and when the housing is moved in the first direction along the rear face of the panel, the tip of the lance is depressed by the locking piece and passes over the locking piece.

When the tip of the lance completely passes over the locking piece, and the housing abuts the end face of the mounting opening and stops, the tip of the lance returns and is locked with the locking piece, thereby making it possible to lock the housing so as to be difficult to move in the second direction.

In the electrical connector according to an applied aspect of the second aspect, the front portion of the housing includes a step-shaped step corresponding to a panel thickness of the panel between the boundary step and the plurality of flanges, and the mounting opening has an opening shape that is different depending on the panel thickness of the panel.

An electrical connector according to a third aspect of the present invention is an electrical connector of a square shape having a housing to be attached to a panel, in which the housing includes a front portion and a rear portion, and the rear portion of the housing as described in the first aspect or the applied aspect thereof and the front portion of the housing in the second aspect or the applied aspect thereof are provided.

In the electrical connector according to the third embodiment of the present invention, the housing may be attached to the front face (outside) of the panel, or the housing may be attached to the rear face (inside) of the panel, and thus a direction of attachment to a panel is not limited.

Moreover, in the electrical connector according to the third aspect, the opening shape of the mounting opening can be varied depending on a panel thickness of a panel.

Furthermore, each electrical connector according to each aspect described above further includes a block key that holds the housing to the panel in a state in which movement is difficult by inserting a part thereof into an end portion of the mounting opening.

Since the electrical connector according to the present invention does not include a pair of locking arms in both wings unlike a conventional connector, it is possible to reduce the external shape. In addition, in the electrical connector according to the present invention, the lance for locking the housing to the panel is arranged in the direction orthogonal to the direction of insertion and removal of the counterpart connector, thereby making it possible to prevent the load from being applied to the lance.

Furthermore, in the electrical connector according to the present invention, the opening shape of the mounting opening provided to the panel is varied to correspond to the panel thickness of the panel, thereby making it possible to share the housing with panels having different panel thicknesses.

DETAILED DESCRIPTION OF THE INVENTION

In order to achieve the aforementioned object, the inventors of the present invention have found a way in which a lance for locking a housing is arranged to a panel in a direction orthogonal to a direction of insertion and removal of a counterpart connector, and have arrived at inventing a novel connector of a panel attachment type based on this. Embodiments of the present invention are hereinafter described with reference to the drawings.

First Embodiment

Figure 1:
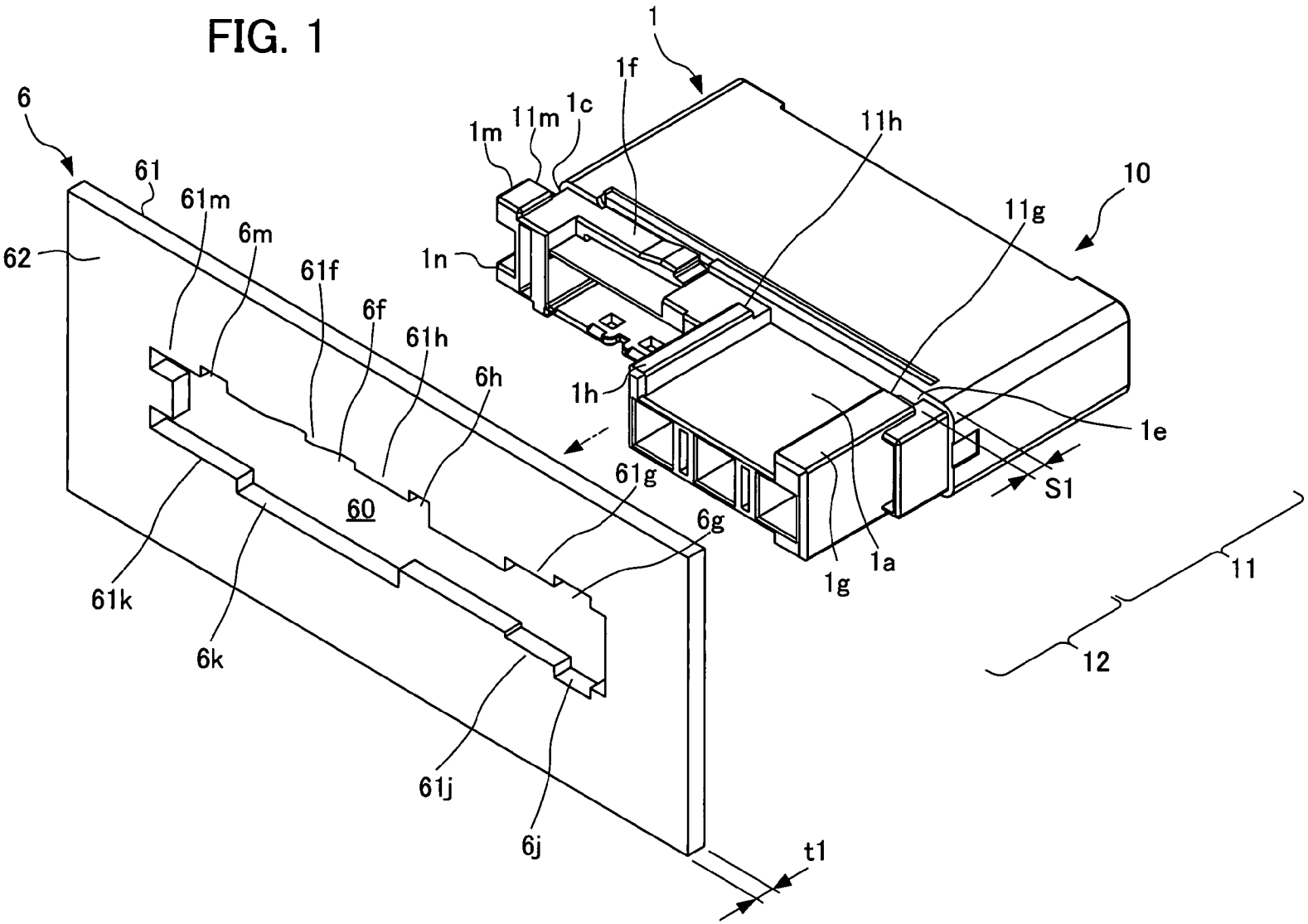
FIG. 1 is a perspective view showing an appearance of a housing provided to an electrical connector according to a first embodiment of the present invention, and showing a state in which a thick panel is arranged opposite thereto.
Figure 2:
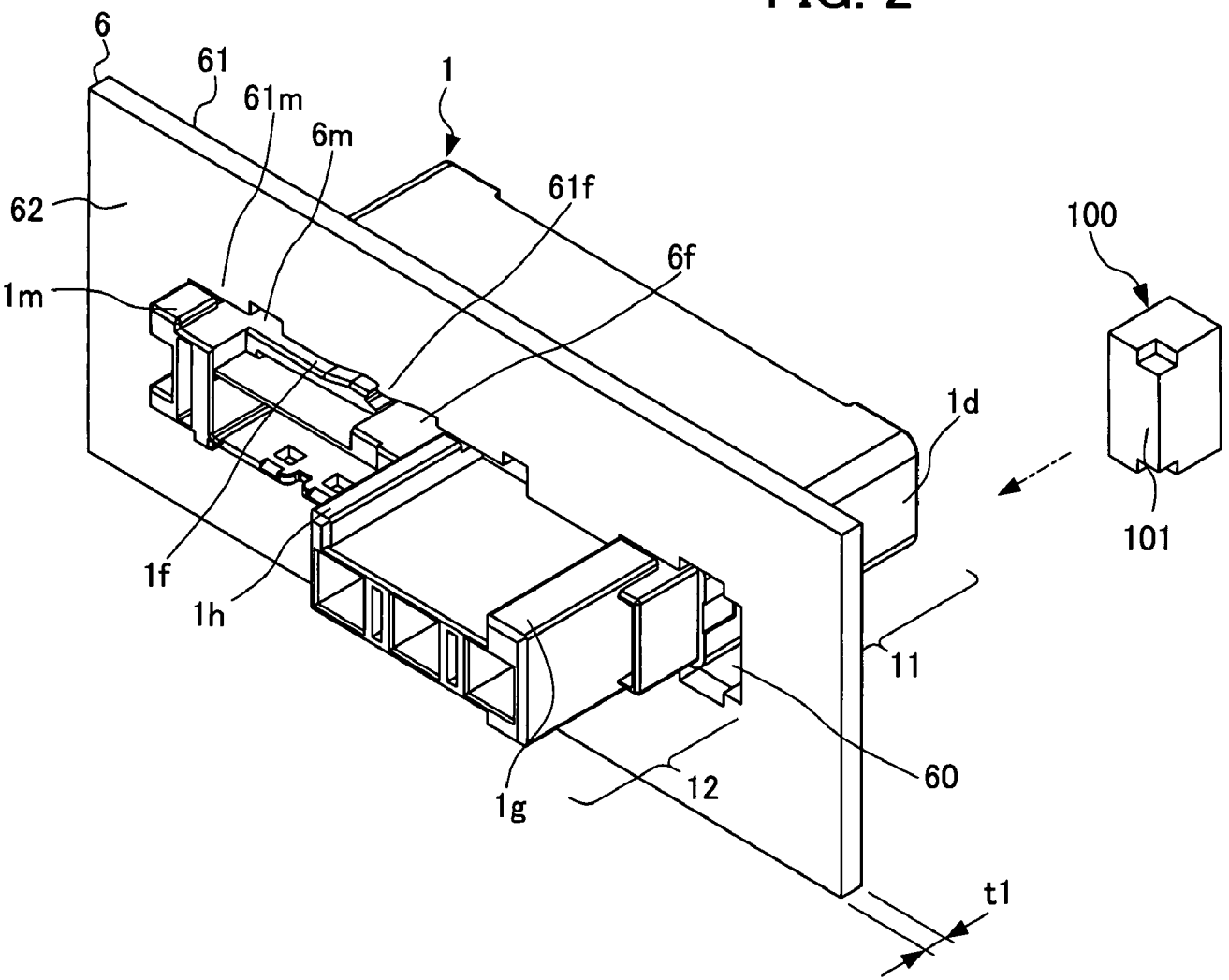
FIG. 2 is a perspective view showing an appearance of the housing provided to the electrical connector according to the first embodiment of the present invention, and showing a state in which the housing is attached from a front face to the thick panel.
Figure 3:
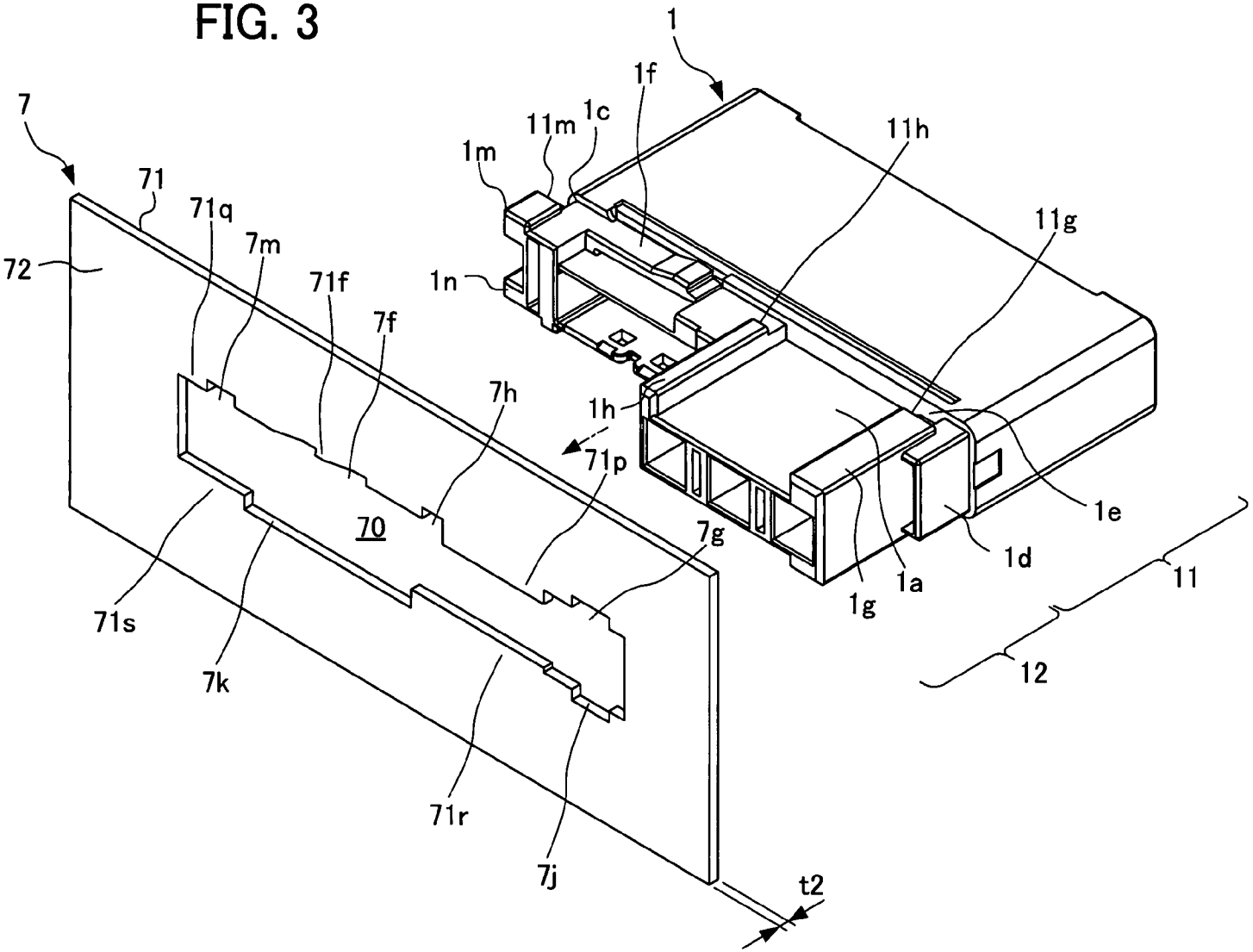
FIG. 3 is a perspective view showing an appearance of the housing provided to the electrical connector according to the first embodiment of the present invention, and showing a state in which a thin panel is arranged opposite thereto.
Figure 4:
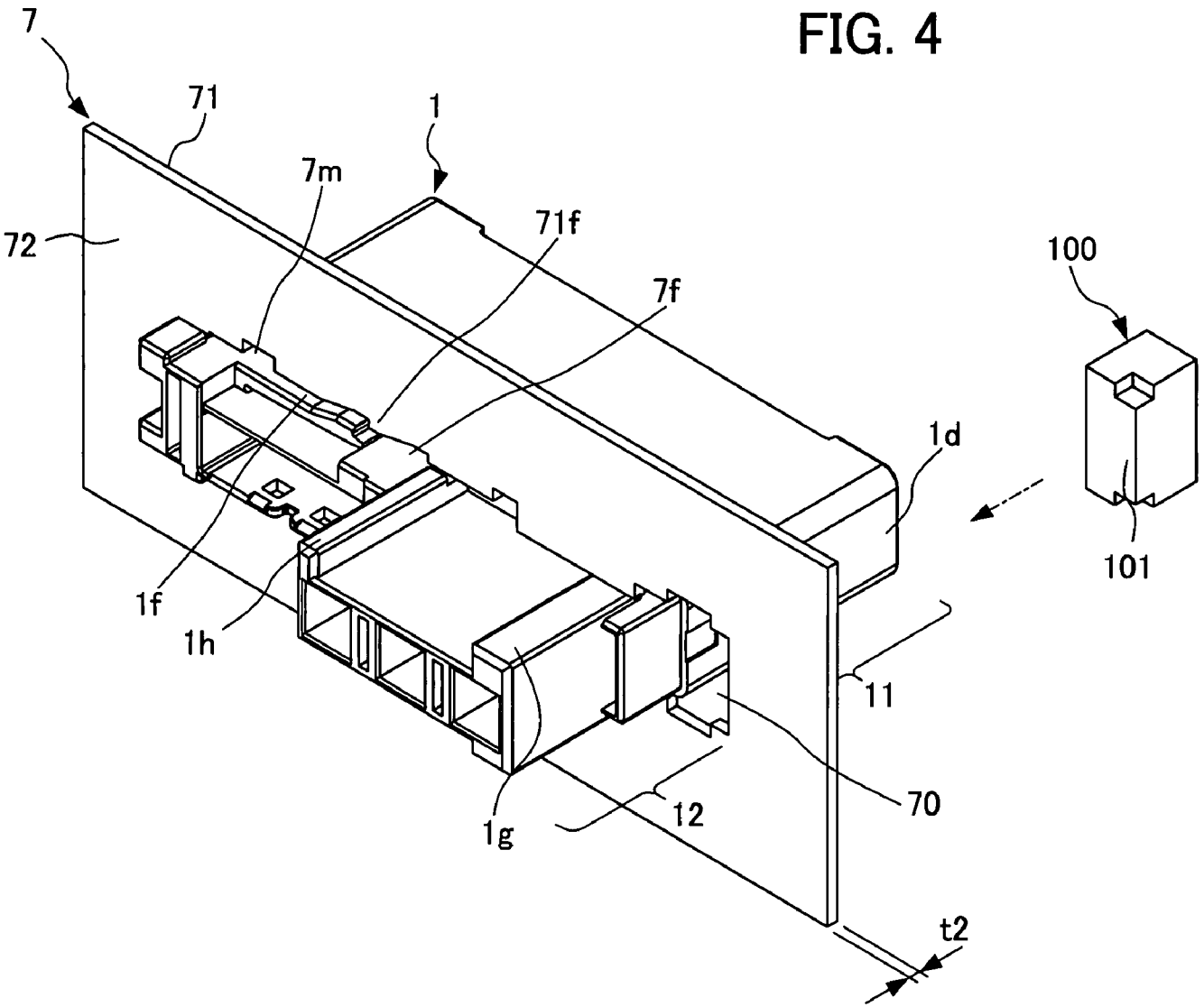
FIG. 4 is a perspective view showing an appearance of the housing provided to the electrical connector according to the first embodiment of the present invention, and showing a state in which the housing is attached from the front face to the thin panel.

Firstly, a configuration of an electrical connector (hereinafter referred to as a connector) according to a first embodiment of the present invention is described. FIGS. 1 to 4 are perspective views each showing an appearance of a housing provided to an electrical connector according to the first embodiment of the present invention, where FIG. 1 shows a state in which a thick panel is arranged opposite thereto; FIG. 2 shows a state in which the thick panel is attached to the housing from a front face; and furthermore, FIG. 3 shows a state in which a thin panel is arranged opposite thereto; and FIG. 4 shows a state in which the thin panel is attached to the housing from the front face.

Figure 5:
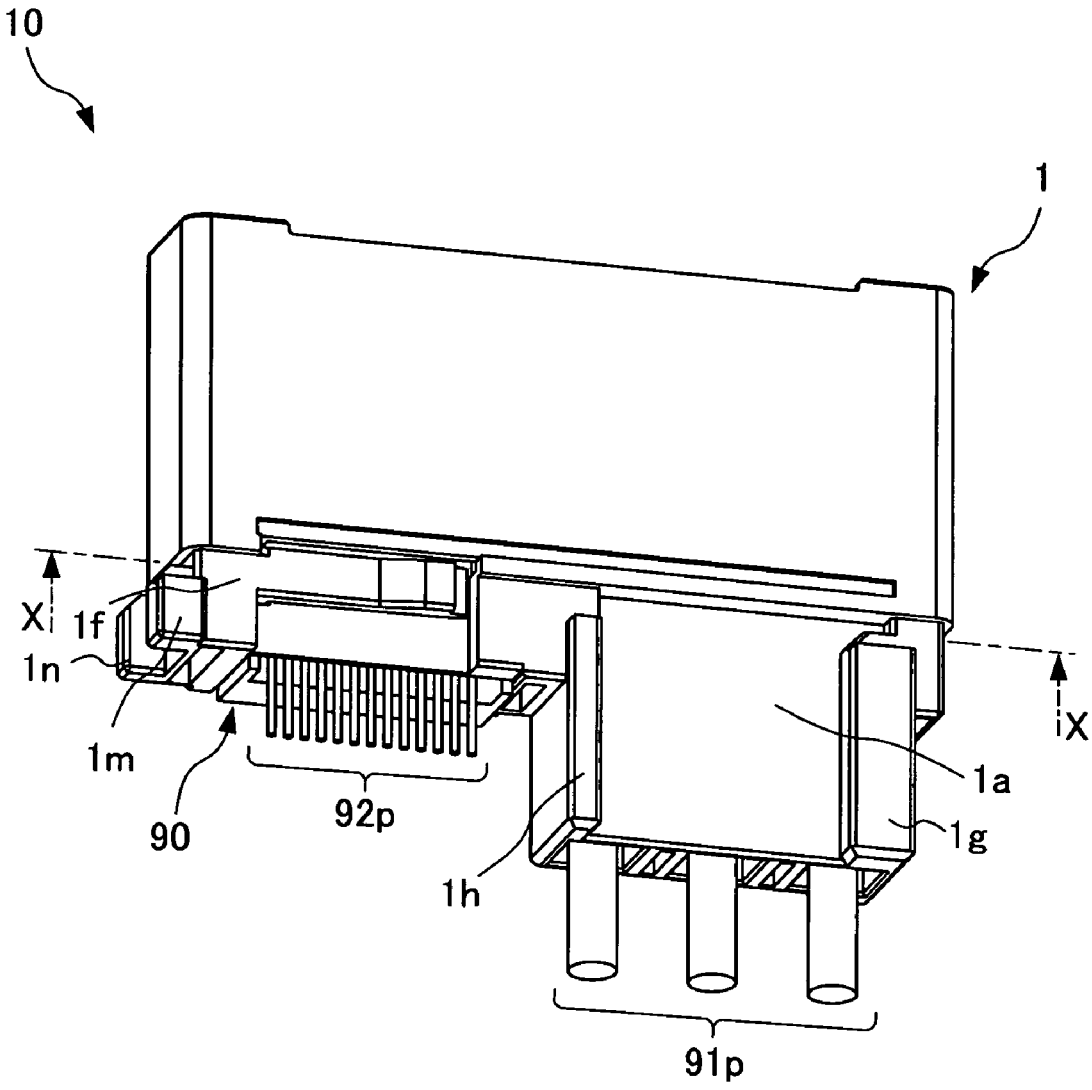
FIG. 5 is a perspective view in which the appearance of the electrical connector according to the first embodiment of the present invention is viewed substantially from the top side.
Figure 6A:
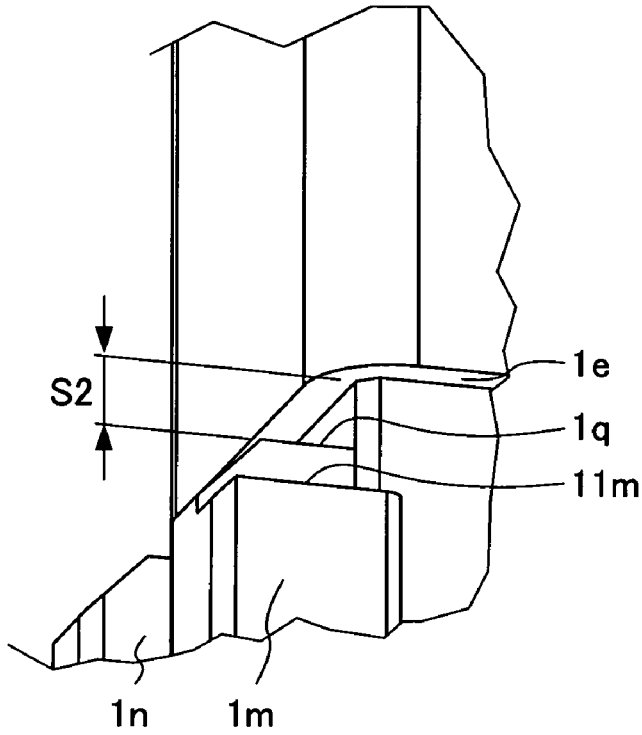
FIG. 6A is an enlarged view of a main portion of the left side of FIG. 5.
Figure 6B:
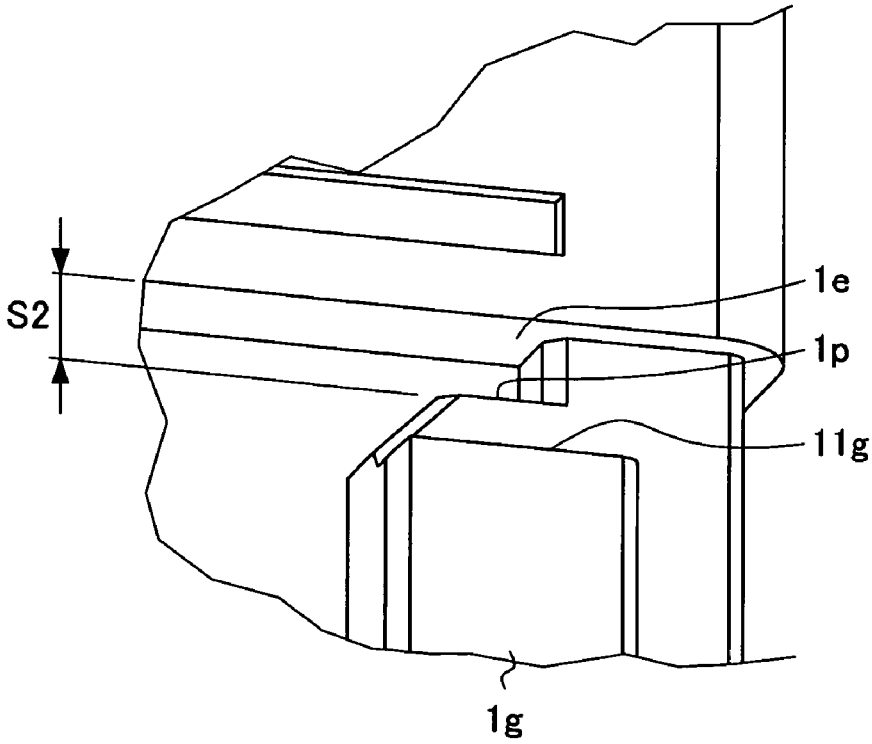
FIG. 6B is an enlarged view of a main portion of the right side of FIG. 5.
Figure 7:
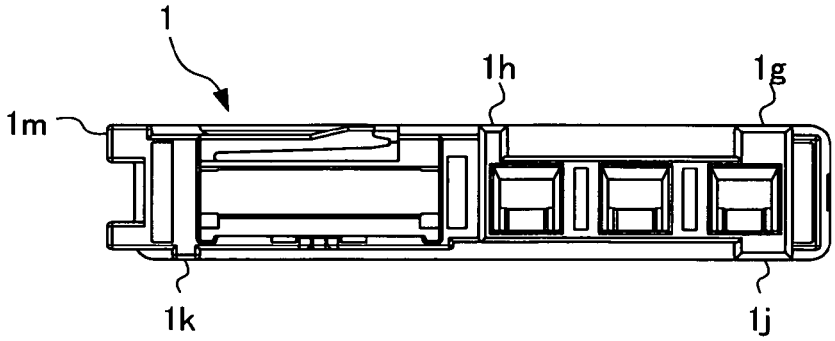
FIG. 7 is a rear view of the housing provided to the electrical connector according to the first embodiment of the present invention.
Figure 8:
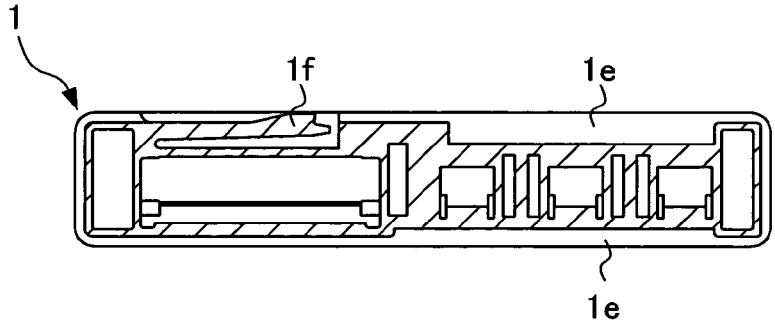
FIG. 8 is a cross-sectional view along a line X-X of FIG. 5.
Figure 9:
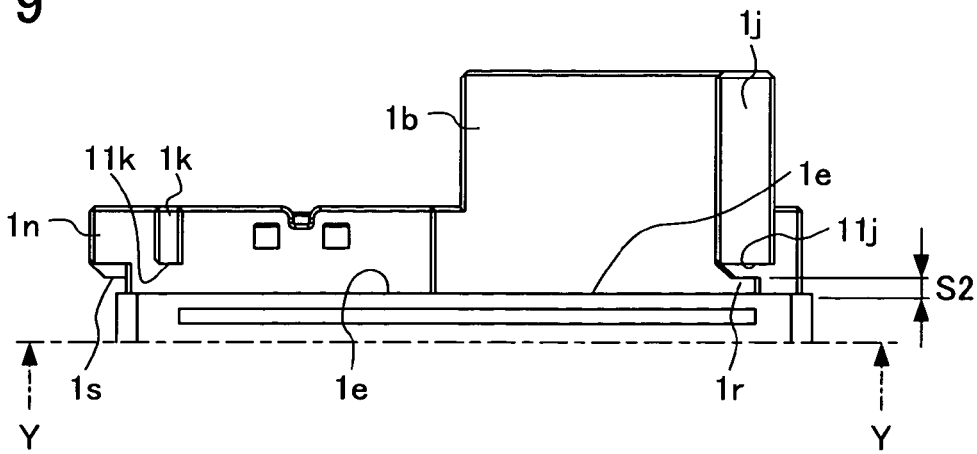
FIG. 9 is a plan view of a side opposite to a lance-forming plane, showing a rear portion of the housing provided to the electrical connector according to the first embodiment of the present invention.
Figure 10:
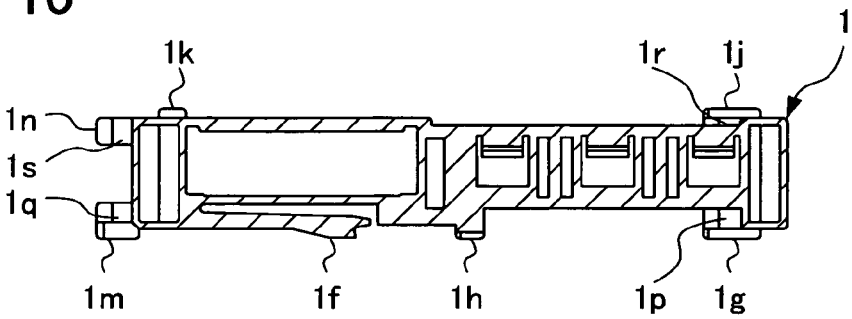
FIG. 10 is a cross-sectional view along a line Y-Y of FIG. 9.

FIG. 5 is a perspective view in which the appearance of the electrical connector according to the first embodiment of the present invention is viewed substantially from the top side. FIG. 6A is an enlarged view of a main portion of the left side of FIG. 5, and FIG. 6B is an enlarged view of a main portion of the right side of FIG. 5. FIG. 7 is a rear view of the housing provided to the electrical connector according to the first embodiment of the present invention. FIG. 8 is a cross-sectional view along a line X-X of FIG. 5. FIG. 9 is a plan view opposite to a lance-forming plane, showing a rear portion of the housing provided to the electrical connector according to the first embodiment of the present invention. FIG. 10 is a cross-sectional view along a line Y-Y of FIG. 9.

With reference to FIG. 1 or 2, a connector 10 according to the first embodiment of the present invention includes a housing 1 of a front face attachment type to be attached to a front face 61 of a thick panel 6. With reference to FIG. 3 or 4, the housing 1 can also be attached to a front face 71 of a thin panel 7. The housing 1 has a front portion 11 and a rear portion 12.

With reference to FIG. 5, the connector 10 according to the embodiment represents a plug. The connector 10 is a hybrid connector, in which a plurality of power supply contacts 91*p* is mounted to a first cavity, and a unit 90 arranging a plurality of signal contacts 92*p* therein is mounted to a second cavity. Regarding the connector 10, a counterpart connector (not shown) is inserted into and removed from the front portion 11 side of the housing 1 (refer to FIG. 2 or 4).

With reference to FIG. 1 or 2, the panel 6 has a rectangular mounting opening 60. The rear portion 12 of the housing 1 is inserted through the mounting opening 60 in a direction substantially orthogonal to the front face 61 of the panel 6.

With reference to FIG. 3 or 4, the panel 7 has a rectangular mounting opening 70. The rear portion 12 of the housing 1 is inserted through the mounting opening 70 in a direction substantially orthogonal to the front face 71 of the panel 7.

With reference to FIG. 1, the rear portion 12 of the housing 1 has a boundary step 1*e* that abuts a periphery of the front face 61 of the mounting opening 60. With reference to FIG. 3, the boundary step 1*e* can abut a periphery of the front face 71 of the mounting opening 70.

With reference to FIG. 1 or 3, the front portion 11 and the rear portion 12 of the housing 1 are distinguished by way of the boundary step 1*e*. The boundary step 1*e* is provided such that a height of a horizontal surface of an external wall of the rear portion 12 is lower than a height of a horizontal surface of an external wall of the front portion 11.

With reference to FIG. 1, the rear portion 12 of the housing 1 has a lance 1*f*. The lance 1*f* is arranged adjacently to the boundary step 1*e*. An end of the lance 1*f* is joined to a first external wall 1*a* of the housing 1. A tip of the lance 1*f* extends away from the first external wall 1*a* in a direction parallel to the front face 61 of the panel 6. Moreover, with reference to FIG. 3, the tip of the lance 1*f* extends away from the first external wall 1*a* in a direction parallel to the front face 71 of the panel 7.

With reference to FIG. 1 or 3, a pair of ribs 1*g* and 1*h* extending toward the boundary step 1*e* is provided to the first external wall 1*a* of the housing 1. End faces 11*g* and 11*h* of the pair of ribs 1*g* and 1*h* configure a part of a flange facing the boundary step 1*e*.

In addition, with reference to FIG. 9, a pair of ribs 1*j* and 1*k* extending toward the boundary step 1*e* is provided to a second external wall 1*b* (opposite to the external wall 1*a*) of the housing 1. End faces 11*j* and 11*k* of the pair of ribs 1*j* and 1*k* configure a part of a flange facing the boundary step 1*e*.

Furthermore, with reference to FIG. 1 or 3, a pair of protruding pieces 1*m* and in protruding outward is provided to a first side wall 1*c* of the housing 1. With reference to FIG. 6A, an end face 11*m* of the protruding piece 1*m* configures a part of a flange facing the boundary step 1*e*.

With reference to FIG. 7, a plurality of flanges, which is configured with the ribs 1*g* and 1*h*, the ribs 1*j* and 1*k* and the protruding piece 1*m*, face the boundary step 1*e*, and are arranged discontinuously around the housing 1.

With reference to FIG. 1, an opposing distance S1 between the end faces of the plurality of flanges and the boundary step 1*e* is slightly wider than a panel thickness t1 of the panel 6.

With reference to FIG. 1, the mounting opening 60 has a concave portion 6*f* through which the lance 1*f* is inserted. Moreover, the mounting opening 60 has concave portions 6*g* and 6*h* through which the pair of ribs 1*g* and 1*h* is inserted. Furthermore, the mounting opening 60 has a concave portion 6*m* through which the protruding piece 1*m* is inserted. In addition, the concave portions 6*f*, 6*g*, 6*h* and 6*m* are notched toward a panel thickness face of the panel 6.

With reference to FIGS. 1 and 9, the mounting opening 60 has concave portions 6*j* and 6*k* through which the pair of ribs 1*j* and 1*k* is inserted. In addition, the concave portions 6*j* and 6*k* are notched toward the panel thickness face of the panel 6.

With reference to FIGS. 1 and 2, the mounting opening 60 has a pair of convex portions 61*g* and 61*h*, where the end faces 11*g* and 11*h* of the pair of ribs 1*g* and 1*h* abut a rear face 62 of the panel 6 when the housing 1 is moved in a first direction along the front face 61 of the panel 6. The convex portions 61*g* and 61*h* continue to the concave portions 6*g* and 6*h*, respectively.

With reference to FIGS. 1 and 2, the mounting opening 60 has a protruding piece 1*m*, where the end face 11*m* of the protruding piece 1*m* abuts the rear face 62 of the panel 6 when the housing 1 is moved in the first direction along the front face 61 of the panel 6. The convex portion 61*m* continues to the concave portion 6*m*.

With reference to FIGS. 1, 2 and 9, the mounting opening 60 has a pair of convex portions 61*j* and 61*k*, where the end faces 11*j* and 11*k* of the pair of ribs 1*j* and 1*k* abut the rear face 62 of the panel 6 when the housing 1 is moved in the first direction along the front face 61 of the panel 6. The convex portions 61*j* and 61*k* continue to the concave portions 6*j* and 6*k*, respectively.

With reference to FIGS. 1 and 2, the mounting opening 60 has a locking piece 61*f* that locks the tip of the lance 1*f* when the housing 1 is moved in the first direction along the front face 61 of the panel 6. The locking piece 61*f* is a convex portion that continues to the concave portion 6*f*.

With reference to FIGS. 3, 4 and 6, the rear portion 12 of the housing 1 has a pair of steps 1*p* and 1*q* corresponding to the thin panel 7. The step 1*p* is lower than the end face 11*g* of the rib 1*g* by one step in a stepwise manner. The step 1*q* is lower than the end face 11*m* of the protruding piece 1*m* by one step in a stepwise manner.

With reference to FIG. 6, the pair of steps 1*p* and 1*q* faces the boundary step 1*e*. An opposing distance S2 between the pair of steps 1*p* and 1*q* and the boundary step 1*e* is slightly wider than a panel thickness t2 of the panel 7 (refer to FIG. 3 or 4).

With reference to FIGS. 3, 4 and 9, the rear portion 12 of the housing 1 has a pair of steps 1*r* and 1*s* corresponding to the thin panel 7. The step 1*r* is lower than the end face 11*j* of the rib 1*j* by one step in a stepwise manner. The step 1*s* lower than the end face 11*n* of the protruding piece 1*n* by one step in a stepwise manner.

With reference to FIG. 9, the pair of steps 1*r* and 1*s* faces the boundary step 1*e*. The opposing distance S2 between the pair of steps 1*r* and 1*s* and the boundary step 1*e* is slightly wider than the panel thickness t2 of the panel 7 (refer to FIG. 3 or 4).

With reference to FIG. 3, the mounting opening 70 has a concave portion 7*f* through which the lance 1*f* is inserted. Moreover, the mounting opening 60 has concave portions 7*g* and 7*h* through which the pair of ribs 1*g* and 1*h* is inserted. In addition, the concave portions 7*f*, 7*g*, 7*h* and 7*m* are notched toward a panel thickness face of the panel 7.

With reference to FIGS. 3, 4 and 6, the mounting opening 70 has a pair of convex portions 71*p* and 71*q*, where the pair of steps 1*p* and 1*q* abuts a rear face 72 of the panel 7 when the housing 1 is moved in the first direction along the front face 71 of the panel 7. The pair of convex portions 71*p* and 71*q* continues to the concave portions 7*h* and 7*m*, respectively.

With reference to FIGS. 3 and 9, the mounting opening 70 has concave portions 7*j* and 7*k* through which the pair of ribs 1*j* and 1*k* is inserted. Moreover, the mounting opening 70 has a concave portion 7*m* through which the protruding piece 1*m* is inserted. In addition, the concave portions 7*j*, 7*k* and 7*m* are notched toward the panel thickness face of the panel 7.

With reference to FIGS. 3, 4 and 9, the mounting opening 70 has a pair of convex portions 71*r* and 71*s*, where the pair of steps 1*r* and 1*s* abuts a rear face 72 of the panel 7 when the housing 1 is moved in the first direction along the front face 71 of the panel 7. The pair of convex portions 71*r* and 71*s* continues to the concave portions 7*j* and 7*k*, respectively.

With reference to FIGS. 3 and 4, the mounting opening 70 has a locking piece 71*f* that locks the tip of the lance 1*f* when the housing 1 is moved in the first direction along the front face 71 of the panel 7. The locking piece 71*f* is a convex portion that continues to the concave portion 7*f*.

Figure 11:
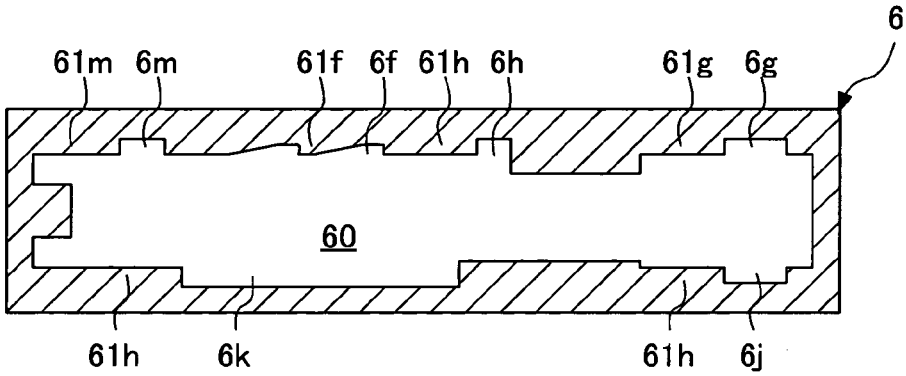
FIG. 11 is a plan view showing a cutting layout of the thick panel, in which the thick panel is viewed from the rear face side.
Figure 12:
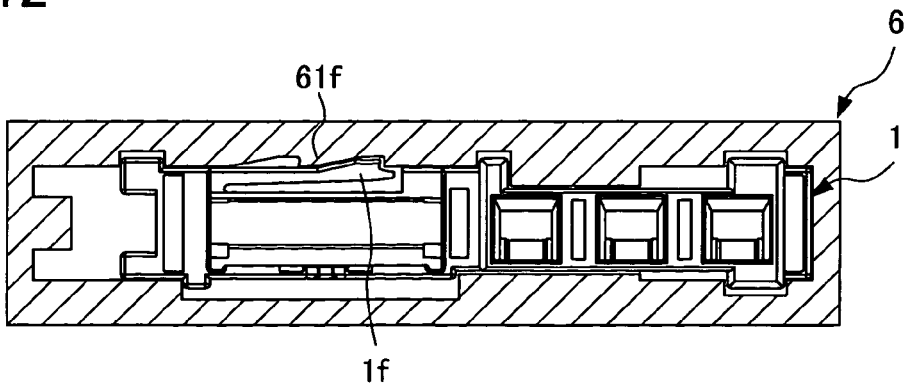
FIG. 12 is a view of a state in which the housing according to the first embodiment of the present invention is inserted through the thick panel shown in FIG. 11, in which the housing is viewed from the back side.
Figure 13:
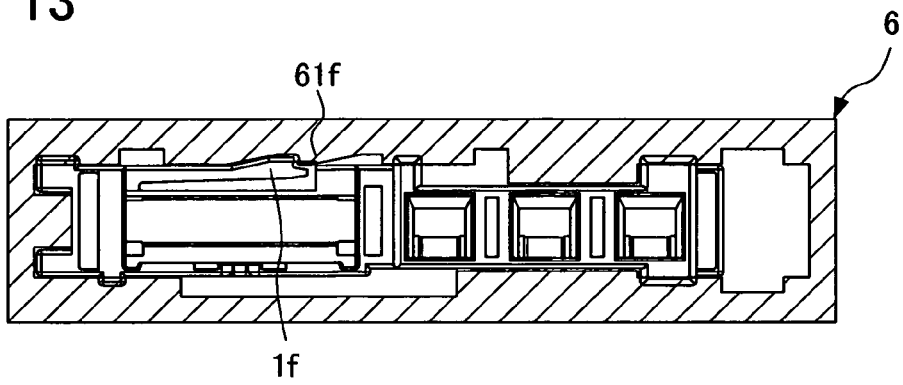
FIG. 13 is a view of a state in which the housing shown in FIG. 12 has been moved in a first direction, in which the housing is viewed from the back side.

Next, operations of the connector 10 according to the first embodiment of the present invention are described. FIG. 11 is a plan view showing a cutting layout of the thick panel, in which the thick panel is viewed from the rear face side. FIG. 12 is a view of a state in which the housing 1 according to the first embodiment of the present invention is inserted through the thick panel shown in FIG. 11, in which the housing is viewed from the back side. FIG. 13 is a view of a state in which the housing 1 shown in FIG. 12 has been moved in the first direction, in which the housing 1 is viewed from the back side.

Figure 14:
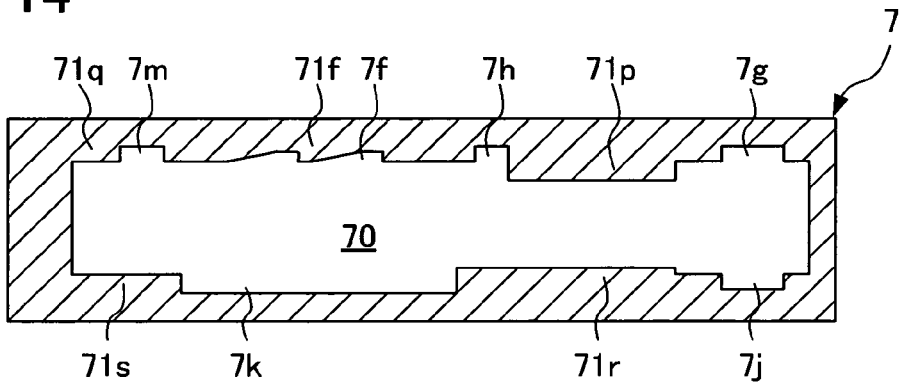
FIG. 14 is a plan view showing a cutting layout of the thin panel, in which the thin panel is viewed from the rear face side.
Figure 15:
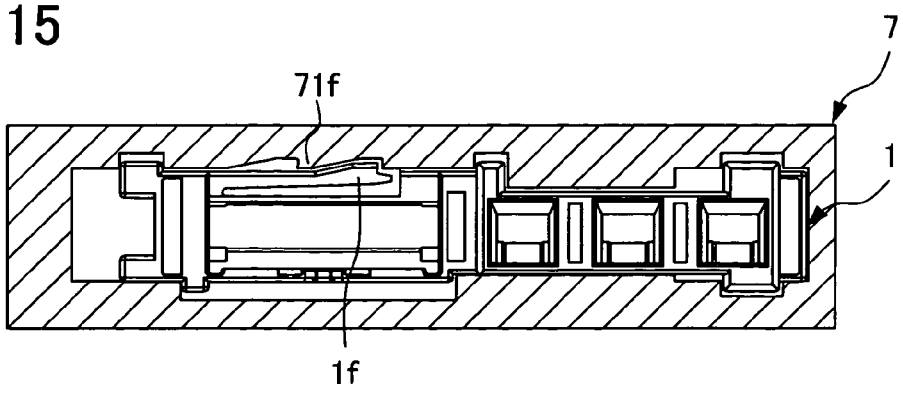
FIG. 15 is a view of a state in which the housing according to the first embodiment of the present invention is inserted through the thin panel shown in FIG. 14, in which the housing is viewed from the back side.
Figure 16:
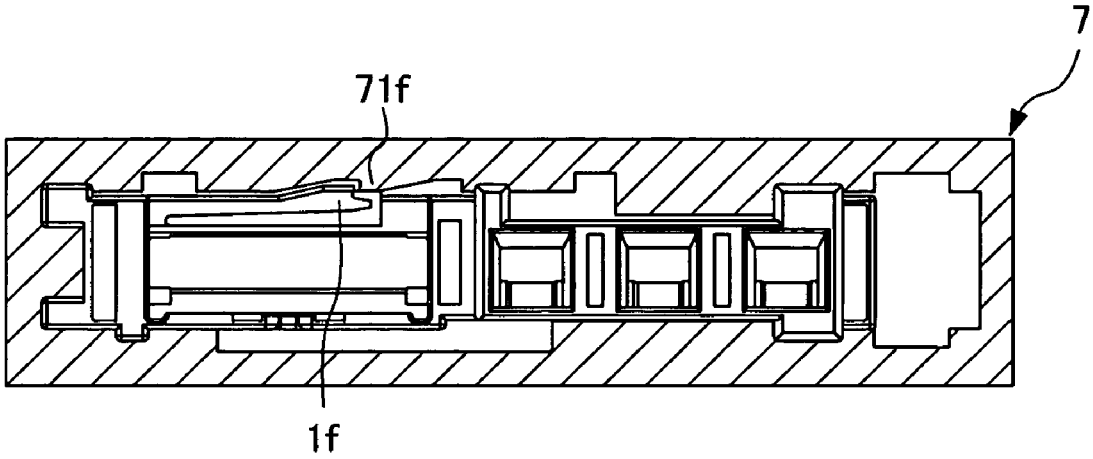
FIG. 16 is a view of a state in which the housing shown in FIG. 15 has been moved in the first direction, in which the housing is viewed from the back side.

FIG. 14 is a plan view showing a cutting layout of the thin panel, in which the thin panel is viewed from the rear face side. FIG. 15 is a view of a state in which the housing 1 according to the first embodiment of the present invention is inserted through the thin panel shown in FIG. 14, in which the housing is viewed from the back side. FIG. 16 is a view of a state in which the housing 1 shown in FIG. 15 has been moved in the first direction, in which the housing 1 is viewed from the back side.

With reference to FIGS. 1 and 12, when the rear portion 12 of the housing 1 is inserted through the mounting opening 60 in the direction substantially orthogonal to the front face 61 of the panel 6, the boundary step 1*e* abuts the periphery of the front face 61 of the mounting opening 60, and can stop. In addition, in this state, the lance 1*f* faces the panel thickness face (concave portion 6*f*) of the mounting opening 60.

With reference to FIGS. 1 to 10, the boundary step 1*e* and the plurality of flanges (end faces 11*g*, 11*h*, 11*j*, 11*k* and 11*m*) are provided so as to sandwich both sides of the periphery of the mounting opening 60, and when the housing 1 is moved in the first direction along the front face 61 of the panel 6, the tip of the lance 1*f* is depressed by the locking piece 61*f* and passes over the locking piece 61*f* (refer to FIGS. 12 and 13).

In addition, with reference to FIG. 13, when the tip of the lance 1*f* completely passes over the locking piece 61*f*, and the housing 1 abuts the end face of the mounting opening 60 and stops, the tip of the lance 1*f* returns and is locked with the locking piece 61*f*, thereby making it possible to lock the housing 1 so as to be difficult to move in a second direction. In other words, the housing 1 can be locked to the panel 6.

By depressing the lance 1*f* from the state of FIG. 13, it is possible to move the housing 1 in the second direction. In other words, the locking with the panel 6 can be released.

With reference to FIGS. 3 to 10, the boundary step 1*e* and the plurality of steps 1*p*, 1*q*, 1*r* and 1*s* are provided so as to sandwich both sides of the periphery of the mounting opening 70, and when the housing 1 is moved in the first direction along the front face 71 of the panel 7, the tip of the lance 1*f* is depressed by the locking piece 71*f* and passes over the locking piece 71*f* (refer to FIGS. 15 and 16).

In addition, with reference to FIG. 16, when the tip of the lance 1*f* completely passes over the locking piece 71*f*, and the housing 1 abuts the end face of the mounting opening 70 and stops, the tip of the lance 1*f* returns and is locked with the locking piece 71*f*, thereby making it possible to lock the housing 1 so as to be difficult to move in the second direction. In other words, the housing 1 can be locked to the panel 7.

By depressing the lance 1*f* from the state of FIG. 16, it is possible to move the housing 1 in the second direction. In other words, the locking with the panel 7 can be released.

In this way, since the connector 10 according to the first embodiment of the present invention does not include a pair of locking arms in both wings unlike a conventional connector, it is possible to reduce the external shape.

Moreover, in the connector 10 according to the first embodiment of the present invention, by arranging the lance 1*f* for locking the housing 1 to the panel 6 or the panel 7 in the direction orthogonal to the direction of insertion and removal of the counterpart connector (not shown), it is possible to prevent the load from being applied to the lance 1*f*.

Furthermore, in the connector 10 according to the first embodiment of the present invention, the rear portion 12 of the housing 1 has the plurality of step-shaped steps 1*p*, 1*q*, 1*r* and 1*s* corresponding to the thin panel 7 between the boundary step 1*e* and the plurality of flanges (end faces 11*g*, 11*h*, 11*j*, 11*k* and 11*m*), and the shape of the mounting opening 70 is made different from the shape of the mounting opening 60, thereby making it possible to attach the housing 1 to the thin panel 7. In other words, the housing 1 can be shared with panels having different panel thicknesses.

With reference to FIG. 1 or 2, the panel thickness t1 of the thick panel 6 is 2 mm in the embodiment. Moreover, with reference to FIG. 3 or 4, the panel thickness t2 of the thin panel 7 is 1 mm in the embodiment. As for the panel 6, the panel thickness t1 may be greater than 1 mm and not more than 2 mm, and the rear portion 12 of the housing 1 can be attached thereto. As for the panel 7, the panel thickness t2 may be not more than 1 mm, and the rear portion 12 of the housing 1 can be attached thereto.

The thick panel 6 and the thin panel 7 may be in a relative relationship with each other, and the panel thickness t1 of the panel 6 may be 3 mm and the panel thickness t2 of the panel 7 may be 2 mm. In addition, in the connector 10 according to the first embodiment of the present invention, although the housing 1 sharing the thick panel 6 and the thin panel 7 has been disclosed, it is also possible to provide the housing 1 corresponding to three panel thicknesses by further adding a step-shaped step corresponding to a panel thickness of a panel.

Second Embodiment

Figure 17:
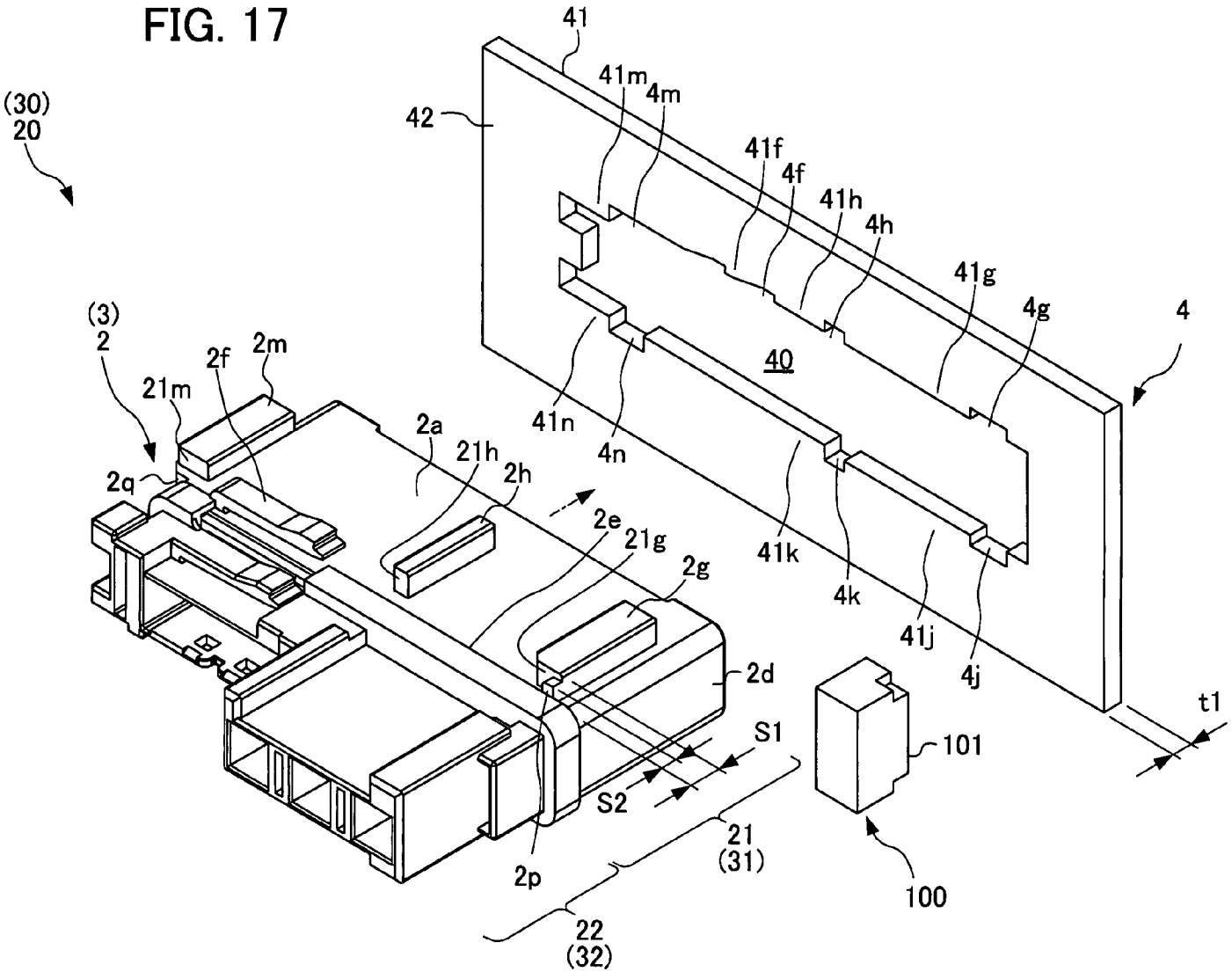
FIG. 17 is a perspective view showing an appearance of a housing provided to an electrical connector according to a second or third embodiment of the present invention, and showing a state in which a thick panel is arranged opposite thereto.

Next, operations of a connector according to a second embodiment of the present invention are described. FIG. 17 is a perspective view showing an appearance of a housing provided to an electrical connector according to a second or third embodiment of the present invention, and showing a state in which a thick panel is arranged opposite thereto.

Figure 18:
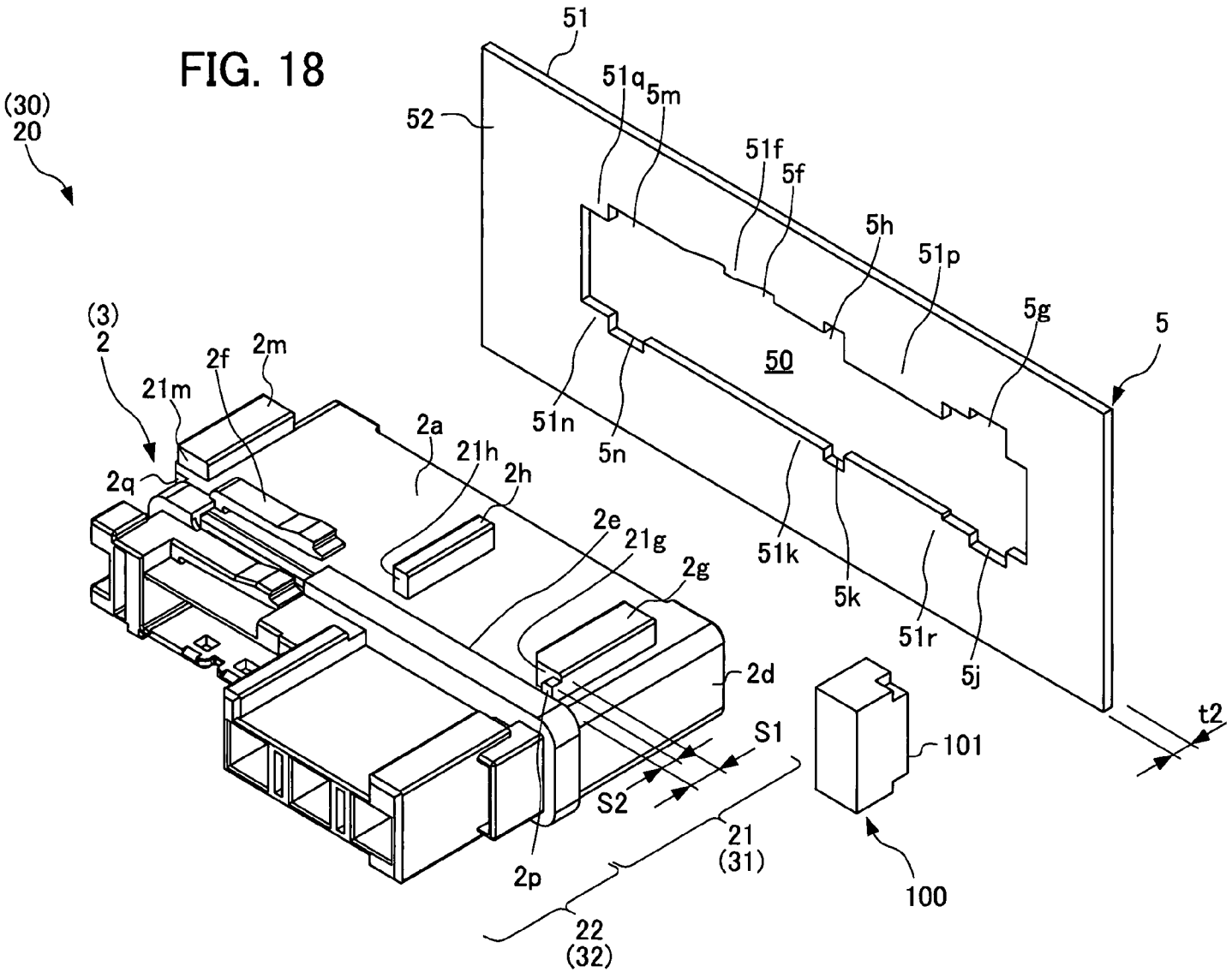
FIG. 18 is a perspective view showing an appearance of the housing provided to the electrical connector according to the second or third embodiment of the present invention, and showing a state in which a thin panel is arranged opposite thereto.
Figure 19:
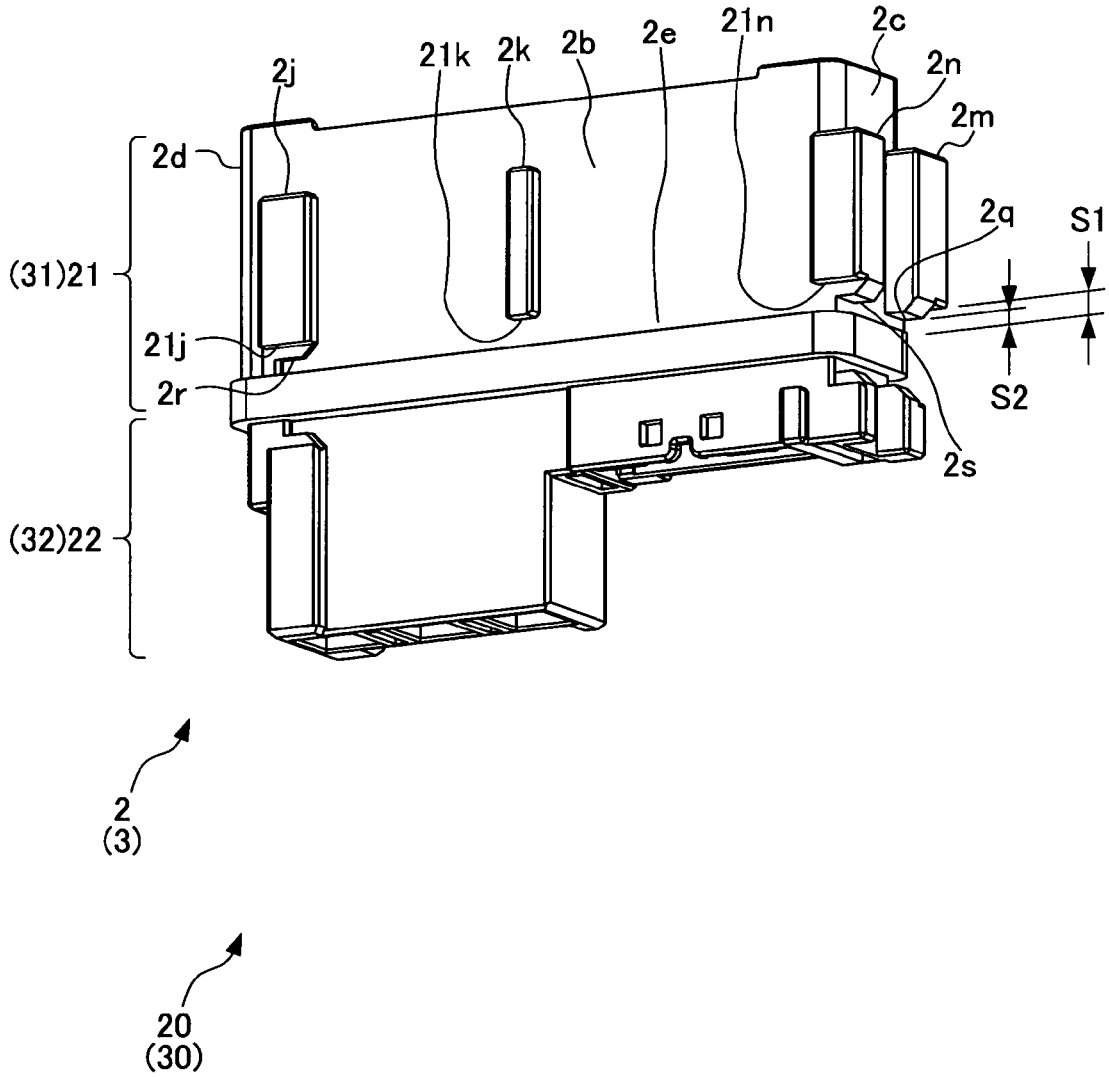
FIG. 19 is a perspective view in which the appearance of the housing provided to the electrical connector according to the second or third embodiment of the present invention is viewed substantially from the bottom side.
Figure 20:
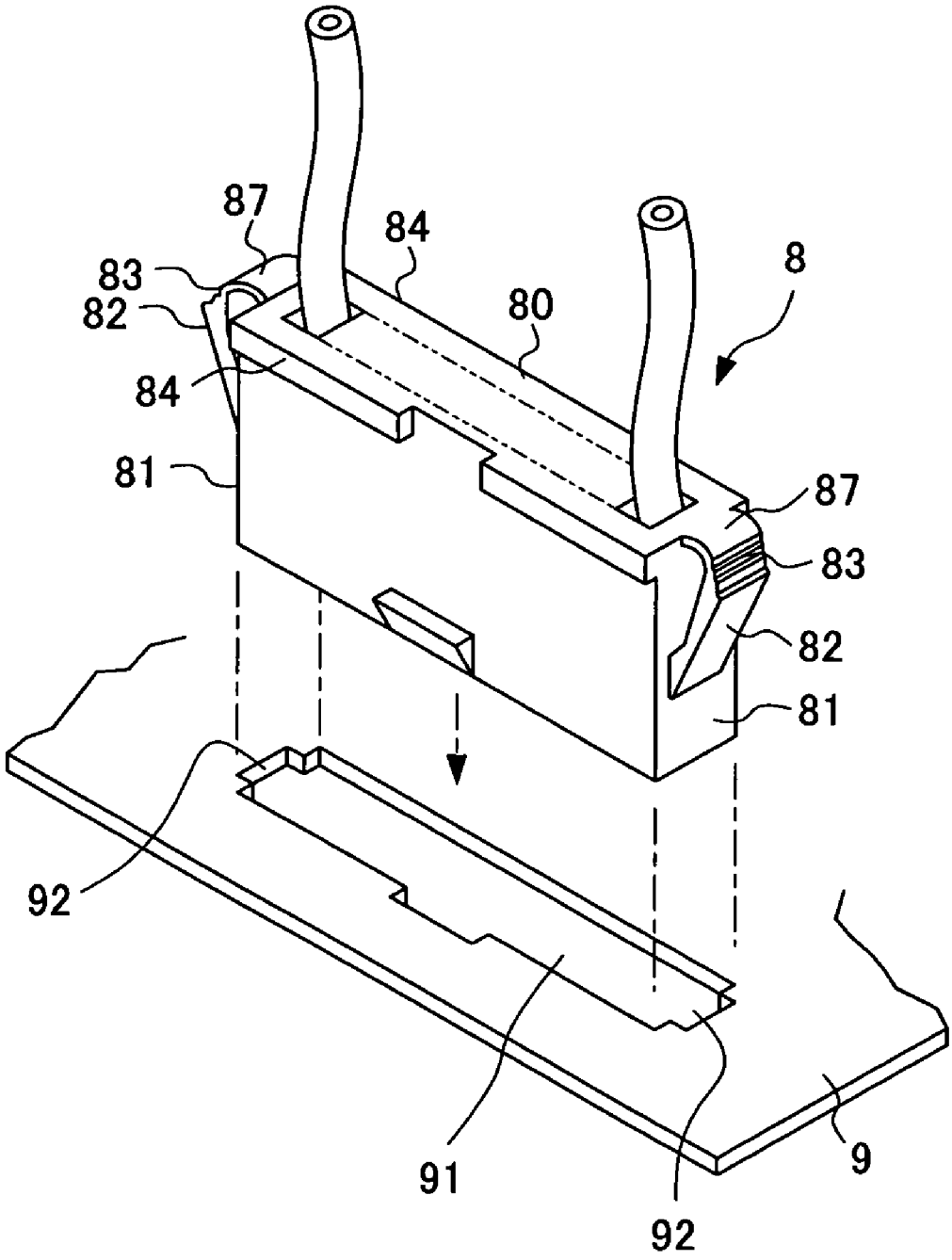
FIG. 20 (PRIOR ART)
FIG. 20 is a perspective view showing an appearance of a connector according to the prior art.

FIG. 18 is a perspective view showing an appearance of the housing provided to the electrical connector according to the second or third embodiment of the present invention, and showing a state in which a thin panel is arranged opposite thereto. FIG. 19 is a perspective view in which the appearance of the housing provided to the electrical connector according to the second or third embodiment of the present invention is viewed substantially from the bottom side.

With reference to FIG. 17, a connector 20 according to the second embodiment of the present invention includes a housing 2 of a rear face attachment type to be attached from a rear face 42 toward a front face 41 of a thick panel 4. With reference to FIG. 18, the housing 2 can also be attached from a rear face 52 toward a front face 51 of a thin panel 5.

As for the housing 2 shown in FIGS. 17 to 19, a rear portion 22 is configured similarly to the rear portion 12 of the housing 1 of the first embodiment, and is a rear portion 32 of a housing 3 according to the third embodiment to be described later. However, in the following description of the second embodiment, an external wall of the rear portion 22 of the housing 2 is treated as being flat, for example.

With reference to FIG. 17, the panel 4 has a rectangular mounting opening 40. A front portion 21 of the housing 2 is inserted through the mounting opening 40 in a direction substantially orthogonal to the rear face 42 of the panel 4.

With reference to FIG. 18, the panel 5 has a rectangular mounting opening 50. The front portion 21 of the housing 2 is inserted through the mounting opening 50 in a direction substantially orthogonal to the rear face 52 of the panel 5.

With reference to FIG. 17, the rear portion 21 of the housing 2 has a boundary step 2*e* that abuts a periphery of the rear face 42 of the mounting opening 40. With reference to FIG. 18, the boundary step 2*e* can abut a periphery of the rear face 52 of the mounting opening 50.

With reference to FIG. 17 or 18, the front portion 21 and the rear portion 22 of the housing 2 are distinguished by way of the boundary step 2*e* as a boundary. The boundary step 2*e* forms an inner flange, in which an external wall thereof is higher than an external wall of the front portion 21 by one step.

With reference to FIG. 17, the front portion 21 of the housing 2 has a lance 2*f*. The lance 2*f* is arranged adjacently to the boundary step 2*e*. An end of the lance 2*f* is joined to a first external wall 2*a* of the housing 2. A tip of the lance 2*f* extends away from the first external wall 2*a* in a direction parallel to the rear face 42 of the panel 4. Moreover, with reference to FIG. 18, the tip of the lance 2*f* extends away from the first external wall 2*a* in a direction parallel to the rear face 52 of the panel 5.

With reference to FIG. 17 or 18, a pair of ribs 2*g* and 2*h* extending toward the boundary step 2*e* is provided to the first external wall 2*a* of the housing 2. End faces 21*g* and 21*h* of the pair of ribs 2*g* and 2*h* configure a part of a flange facing the boundary step 2*e*.

In addition, with reference to FIG. 19, a pair of ribs 2*j* and 2*k* extending toward the boundary step 2*e* is provided to a second external wall 2*b* (opposite to the external wall 2*a*) of the housing 2. End faces 21*j* and 21*k* of the pair of ribs 2*j* and 2*k* configure a part of a flange facing the boundary step 2*e*.

Furthermore, with reference to FIGS. 17 to 19, a pair of protruding pieces 2*m* and 2*n* protruding outward is provided to a first side wall 2*c* of the housing 2. End faces 21*m* and 21*n* of the pair of protruding pieces 2*m* and 2*n* configure a part of a flange facing the boundary step 2*e*.

With reference to FIGS. 17 to 19, a plurality of flanges, which is configured with the ribs 2*g* and 2*h*, the ribs 2*j* and 2*k* and the pair of protruding pieces 2*m* and 2*n*, faces the boundary step 2*e*, and is arranged discontinuously around the housing 2.

With reference to FIGS. 17 to 19, an opposing distance S1 between the end faces of the plurality of flanges and the boundary step 2*e* is slightly wider than a panel thickness t1 of the panel 4.

With reference to FIG. 17, the mounting opening 40 has a concave portion 4*f* through which the lance 2*f* is inserted. Moreover, the mounting opening 40 has concave portions 4*g* and 4*h* through which the pair of ribs 2*g* and 2*h* is inserted. Furthermore, the mounting opening 40 has a concave portion 4*m* through which the protruding piece 2*m* is inserted. In addition, the concave portions 4*f*, 4*g*, 4*h* and 4*m* are notched toward a panel thickness face of the panel 4.

With reference to FIGS. 17 and 19, the mounting opening 40 has concave portions 4*j* and 4*k* through which the pair of ribs 2*j* and 2*k* is inserted. Moreover, the mounting opening 40 has a concave portion 4*n* through which the protruding piece 2*n* is inserted. In addition, the concave portions 4*j*, 4*k* and 4*n* are notched toward a panel thickness face of the panel 6.

With reference to FIG. 17, the mounting opening 40 has a pair of convex portions 41*g* and 41*h*, where the end faces 21*g* and 21*h* of the pair of ribs 2*g* and 2*h* abut the front face 41 of the panel 4 when the housing 2 is moved in a first direction along the rear face 42 of the panel 4. The convex portions 41*g* and 41*h* continue to the concave portions 4*g* and 4*h*, respectively.

With reference to FIG. 17, the mounting opening 40 has a protruding piece 41*m*, where the end face 21*m* of the protruding piece 2*m* abuts the front face 41 of the panel 4 when the housing 2 is moved in the first direction along the rear face 42 of the panel 4. The convex portion 41*m* continues to the concave portion 4*m*.

With reference to FIGS. 17 and 19, the mounting opening 40 has a pair of convex portions 41*g* and 41*h*, where the end faces 21*j* and 21*k* of the pair of ribs 2*j* and 2*k* abut the rear face 42 of the panel 4 when the housing 2 is moved in the first direction along the rear face 42 of the panel 4. The convex portions 41*j* and 41*k* continue to the concave portions 4*j* and 4*k*, respectively.

With reference to FIGS. 17 and 19, the mounting opening 40 has a protruding piece 41*n*, where the end face 21*n* of the protruding piece 2*n* abuts the front face 41 of the panel 4 when the housing 2 is moved in the first direction along the rear face 42 of the panel 4. The convex portion 41*n* continues to the concave portion 4*n*.

With reference to FIG. 17, the mounting opening 40 has a locking piece 41*f* that locks the tip of the lance 2*f* when the housing 2 is moved in the first direction along the rear face 42 of the panel 4. The locking piece 41*f* is a convex portion that continues to the concave portion 4*f*.

With reference to FIGS. 18 and 19, the front portion 21 of the housing 2 has a pair of steps 2*p* and 2*q* corresponding to the thin panel 5. The step 2*p* is lower than the end face 21*g* of the rib 2*g* by one step in a stepwise manner. The step 2*q* is lower than the end face 21*m* of the protruding piece 2*m* by one step in a stepwise manner.

With reference to FIG. 18, the pair of steps 2*p* and 2*q* faces the boundary step 2*e*. An opposing distance S2 between the pair of steps 2*p* and 2*q* and the boundary step 2*e* is slightly wider than a panel thickness t2 of the panel 5 (refer to FIG. 17).

With reference to FIGS. 18 and 19, the front portion 21 of the housing 2 has a pair of steps 2*r* and 2*s* corresponding to the thin panel 5. The step 2*r* is lower than the end face 21*j* of the rib 2*j* by one step in a stepwise manner. The step 2*s* is lower than the end face 21*n* of the protruding piece 2*n* by one step in a stepwise manner.

With reference to FIG. 19, the pair of steps 2*r* and 2*s* faces the boundary step 2*e*. The opposing distance S2 between the pair of steps 2*r* and 2*s* and the boundary step 2*e* is slightly wider than the panel thickness t2 of the panel 5 (refer to FIG. 17 or 18).

With reference to FIG. 18, the mounting opening 50 has a concave portion 5*f* through which the lance 2*f* is inserted. Moreover, the mounting opening 50 has concave portions 5*g* and 5*h* through which the pair of ribs 2*g* and 2*h* is inserted. In addition, the concave portions 5*f*, 5*g* and 5*h* are notched toward a panel thickness face of the panel 5.

With reference to FIG. 18, the mounting opening 50 has a pair of convex portions 51*p* and 51*q*, where the pair of steps 2*p* and 2*q* abuts a front face 51 of the panel 5 when the housing 2 is moved in the first direction along the rear face 52 of the panel 5. The pair of convex portions 51*p* and 51*q* continues to the concave portions 5*g* and 5*h*, respectively.

With reference to FIGS. 18 and 19, the mounting opening 50 has concave portions 5*j* and 5*k* through which the pair of ribs 2*j* and 2*k* is inserted. Moreover, the mounting opening 50 has concave portions 5*m* and 5*n* through which the pair of protruding pieces 2*m* and 2*n* is inserted. In addition, the concave portions 5*j*, 5*k*, 5*m* and 5*n* are notched toward the panel thickness face of the panel 5.

With reference to FIGS. 18 and 19, the mounting opening 50 has a pair of convex portions 51*r* and 51*n*, where the steps 2*r* and 2*s* abut the front face 51 of the panel 5 when the housing 2 is moved in the first direction along the rear face 52 of the panel 5. The pair of convex portions 51*r* and 51*n* continues to the concave portions 5*j* and 5*n*, respectively.

With reference to FIG. 18, the mounting opening 50 has a locking piece 51*f* that locks the tip of the lance 2*f* when the housing 2 is moved in the first direction along the rear face 52 of the panel 5. The locking piece 51*f* is a convex portion that continues to the concave portion 5*f*.

Next, operations of the connector 20 according to the second embodiment of the present invention are described.

With reference to FIGS. 17 and 19, when the front portion 21 of the housing 2 is inserted through the mounting opening 40 in a direction substantially orthogonal to the rear face 42 of the panel 4, the boundary step 2*e* abuts the periphery of the rear face 42 of the mounting opening 40, and can stop. In addition, in this state, the lance 2*f* faces the panel thickness face (concave portion 4*f*) of the mounting opening 40.

With reference to FIG. 17 or 19, the boundary step 2*e* and the plurality of flanges (end faces 21*g*, 21*h*, 21*j*, 21*k*, 21*m* and 21*n*) are provided so as to sandwich both sides of the periphery of the mounting opening 40, and when the housing 2 is moved in the first direction along the rear face 42 of the panel 4, the tip of the lance 2*f* is depressed by the locking piece 41*f* and passes over the locking piece 41*f*.

With reference to FIG. 17, when the tip of the lance 2*f* completely passes over the locking piece 41*f*, and the housing 2 abuts the end face of the mounting opening 40 and stops, the tip of the lance 2*f* returns and is locked with the locking piece 41*f*, thereby making it possible to lock the housing 2 so as to be difficult to move in the second direction. In other words, the housing 2 can be locked to the panel 4.

On the other hand, by depressing the lance 2*f*, it is possible to move the housing 2 in the second direction. In other words, the locking with the panel 4 can be released.

With reference to FIGS. 18 and 19, the boundary step 2*e* and the plurality of steps 2*p*, 2*q*, 2*r* and 2*s* sandwich both sides of the periphery of the mounting opening 50, and when the housing 2 is moved in the first direction along the rear face 52 of the panel 5, the tip of the lance 2*f* is depressed by the locking piece 51*f* and passes over the locking piece 51*f*.

In addition, with reference to FIG. 18, when the tip of the lance 2*f* completely passes over the locking piece 51*f*, and the housing 2 abuts the end face of the mounting opening 50 and stops, the tip of the lance 2*f* returns and is locked with the locking piece 51*f*, thereby making it possible to lock the housing 2 so as to be difficult to move in the second direction. In other words, the housing 2 can be locked to the panel 5.

On the other hand, by depressing the lance 2*f*, it is possible to move the housing 2 in the second direction. In other words, the locking with the panel 5 can be released.

In this way, since the connector 20 according to the second embodiment of the present invention does not include a pair of locking arms in both wings unlike a conventional connector, it is possible to reduce the external shape.

Moreover, in the connector 20 according to the second embodiment of the present invention, by arranging the lance 2*f* for locking the housing 2 to the panel 4 or the panel 5 in the direction orthogonal to the direction of insertion and removal of the counterpart connector (not shown), it is possible to prevent the load from being applied to the lance 2*f*.

Furthermore, in the connector 20 according to the second embodiment of the present invention, the front portion 21 of the housing 2 has the plurality of step-shaped steps 2*p*, 2*q*, 2*r* and 2*s* corresponding to the thin panel 5 between the boundary step 2*e* and the plurality of flanges (end faces 21*g*, 21*h*, 21*j*, 21*k*, 21*m* and 21*n*), and the mounting opening 50 is made different from the mounting opening 40, thereby making it possible to attach the housing 2 to the thin panel 5. In other words, the housing 2 can be shared with panels having different panel thicknesses.

With reference to FIG. 17, the panel thickness t1 of the thick panel 4 is 2 mm in the embodiment. Moreover, with reference to FIG. 18, the panel thickness t2 of the thin panel 5 is 1 mm in the embodiment. As for the panel 4, the panel thickness t1 may be greater than 1 mm and no more than 2 mm, and the front portion 21 of the housing 2 can be attached thereto. As for the panel 5, the panel thickness t2 may be no more than 1 mm, and the front portion 21 of the housing 2 can be attached thereto.

The thick panel 4 and the thin panel 5 may be in a relative relationship with each other, and the panel thickness t1 of the panel 4 may be 3 mm and the panel thickness t2 of the panel 5 may be 2 mm. In addition, in the connector 20 according to the second embodiment of the present invention, although the housing 2 sharing the thick panel 4 and the thin panel 5 has been disclosed, it is also possible to provide the housing 2 corresponding to three panel thicknesses by further adding a step-shaped step corresponding to a panel thickness of a panel.

Third Embodiment

Next, a configuration and operations of a connector according to a third embodiment of the present invention are described.

With reference to FIG. 1 or 2 and FIG. 17, a connector 30 according to the third embodiment of the present invention includes a housing 3 of a front face attachment type to be attached to the front face 61 of the thick panel 6. With reference to FIG. 3 or 4 and FIG. 17, the housing 3 can also be attached to the front face 71 of the thin panel 7.

With reference to FIG. 17, the connector 30 according to the third embodiment of the present invention includes the housing 3 of a rear face attachment type to be attached from the rear face 42 toward the front face 41 of the thick panel 4. With reference to FIG. 18, the housing 3 can also be attached from the rear face 52 toward the front face 51 of the thin panel 5.

The rear portion 32 of the housing 3 shown in FIGS. 17 to 19 is configured similarly to the rear portion 12 of the housing 1. Moreover, the front portion 31 of the housing 3 is configured similarly to the front portion 21 of the housing 2.

According to the above, in the connector 30 according to the third embodiment of the present invention, the housing 3 may be attached to the front face (outside) of the panel 6 or the panel 7, or the housing 3 may be attached to the rear face (inside) of the panel 4 or the panel 5, thereby providing an advantage in that a direction for attaching to a panel is not limited.

In addition, in the connector 30 according to the third embodiment of the present invention, an opening shape of the mounting opening is varied to corresponding to the panel thickness of the panel, thereby making it possible to share the housing 3 with panels having different panel thicknesses.

Next, the connectors 10, 20 and 30 according to the first to third embodiments include a block key 100 that holds the first to third housings 1, 2 and 3 in a stable state in which movement is difficult.

With reference to FIG. 2, a part 101 of the block key 100 is inserted into an end portion of the mounting opening 60. The end portion of the mounting opening 60 opens in an inverted-T shape, and the block key 100 is inserted into the end portion of the mounting opening 60 along a second side wall 1*d* of the housing 1, thereby making it possible to securely hold the connector 10 to the panel 6.

With reference to FIG. 4, the part 101 of the block key 100 is inserted into an end portion of the mounting opening 70. The end portion of the mounting opening 70 opens in an inverted-T shape, and the block key 100 is inserted into the end portion of the mounting opening 70 along the second side wall 1*d* of the housing 1, thereby making it possible to securely hold the connector 10 to the panel 7.

With reference to FIG. 17, the part 101 of the block key 100 is inserted into an end portion of the mounting opening 70. The end portion of the mounting opening 40 opens in an inverted-T shape, and the block key 100 is inserted into the end portion of the mounting opening 40 along a second side wall 2*d* of the housing 2, thereby making it possible to securely hold the connector 20 to the panel 4.

With reference to FIG. 18, the part 101 of the block key 100 is inserted into an end portion of the mounting opening 50. The end portion of the mounting opening 50 opens in an inverted-T shape, and the block key 100 is inserted into the end portion of the mounting opening 50 along the second side wall 2*d* of the housing 2, thereby making it possible to securely hold the connector 20 to the panel 5.

Since the electrical connector according to the present invention can omit a locking arm as described above, the external shape thereof can be reduced. In addition, in the electrical connector according to the present invention, since the lance for locking the housing to the panel is arranged in the direction orthogonal to the direction of insertion and removal of the counterpart connector, the load is not applied to the lance. Furthermore, in the electrical connector according to the present invention, the opening shape of the mounting opening provided to the panel is varied to correspond to the panel thickness of the panel, thereby making it possible to share the housing with panels having different panel thicknesses.

What is claimed is:

1. An electrical connector of a square shape having a housing of a front face attachment type to be attached to a front face of a panel, wherein the housing comprises a front portion and a rear portion, wherein the panel comprises a mounting opening of rectangular shape through which the rear portion of the housing is inserted in a direction substantially orthogonal to the front face of the panel, wherein the rear portion of the housing includes:

a boundary step abutting a periphery of the front face of the mounting opening;

a lance arranged adjacently to the boundary step, in which an end thereof joins a first external wall of the housing, and a tip thereof extends away from the first external wall in a direction parallel to the front face of the panel; and a plurality of flanges arranged discontinuously around the housing to oppose the boundary step, wherein the mounting opening includes:

a plurality of concave portions notched toward a panel thickness face of the panel through which the lance and the plurality of flanges are inserted; and a plurality of convex portions, where the plurality of flanges abuts the rear face of the panel when the housing is moved in a first direction along the front face of the panel, and wherein the plurality of convex portions includes a locking piece that locks the tip of the lance when the housing is moved in the first direction along the front face of the panel, such that the housing is difficult to move in a second direction.

2. The electrical connector according to claim 1, wherein the rear portion of the housing includes a step-shaped step corresponding to a panel thickness of the panel between the boundary step and the plurality of flanges, and wherein the mounting opening has an opening shape that is different depending on the panel thickness of the panel.

3. An electrical connector of a square shape having a housing of a rear face attachment type to be attached from a rear face to a front face of a panel, wherein the housing comprises a front portion and a rear portion, wherein the panel comprises a mounting opening of rectangular shape through which a front portion of the housing is inserted in a direction substantially orthogonal to the rear face of the panel, wherein the front portion of the housing includes:

a boundary step abutting a periphery of the rear face of the mounting opening;

a lance arranged adjacently to the boundary step, in which an end thereof joins a first external wall of the housing, and a tip thereof extends away from the first external wall in a direction parallel to the rear face of the panel; and a plurality of flanges arranged discontinuously around the housing to oppose the boundary step, wherein the mounting opening includes:

a plurality of concave portions notched toward a panel thickness face of the panel through which the lance and the plurality of flanges are inserted; and a plurality of convex portions, where the plurality of flanges abuts the front face of the panel when the housing is moved in a first direction along the rear face of the panel, and wherein the plurality of convex portions includes a locking piece that locks the tip of the lance when the housing is moved in the first direction along the rear face of the panel, such that the housing is difficult to move in a second direction.

4. The electrical connector according to claim 3, wherein the front portion of the housing includes a step-shaped step corresponding to a panel thickness of the panel between the boundary step and the plurality of flanges, and wherein the mounting opening has an opening shape that is different depending on the panel thickness of the panel.

5. An electrical connector of a square shape, comprising a housing to be attached to a panel, wherein the housing includes a front portion and a rear portion, and wherein the rear portion of the housing according to any one of claims 1 and 2 and the front portion of the housing according to any one of claims 3 and 4 are provided.

6. The electrical connector according to claim 1, further comprising a block key that holds the housing to the panel in a state in which movement is difficult by inserting a part thereof into an end portion of the mounting opening.

7. The electrical connector according to claim 3, further comprising a block key that holds the housing to the panel in a state in which movement is difficult by inserting a part thereof into an end portion of the mounting opening.

* * * * *